US005518175A

United States Patent [19]

Yeremian

[11] Patent Number: 5,518,175

[45] Date of Patent: May 21, 1996

[54] MAIL SLOT MOUNTING ASSEMBLY

[76] Inventor: Noubar Yeremian, 360 Upper Gulph Rd., Radnor, Pa. 19087

[21] Appl. No.: 337,952

[22] Filed: Nov. 10, 1994

[51] Int. Cl.[6] ..... A47G 29/12

[52] U.S. Cl. ..... 232/19; 232/43.4; 49/171

[58] Field of Search ..... 232/19, 43.4; 49/171

[56] References Cited

U.S. PATENT DOCUMENTS

| | | | |
|---|---|---|---|
| 1,512,307 | 10/1924 | Pratt | 232/19 |
| 1,538,591 | 5/1925 | Rastetter | 232/19 |
| 1,579,520 | 4/1926 | Fleming | 232/19 |
| 1,799,164 | 4/1931 | Griswold | 49/171 |
| 2,163,356 | 6/1939 | Solberg | 232/43.4 |
| 2,229,594 | 1/1941 | Seiler | 49/171 |
| 2,426,271 | 8/1947 | Johnson | 232/19 |
| 2,849,175 | 8/1958 | Thieman | 232/19 |
| 5,287,654 | 2/1994 | Davlantes | 49/171 |
| 5,377,908 | 1/1995 | Redman | 232/43.4 |

FOREIGN PATENT DOCUMENTS

| | | | |
|---|---|---|---|
| 1034972 | 7/1966 | United Kingdom | 232/19 |

*Primary Examiner*—Michael J. Milano
*Attorney, Agent, or Firm*—Ratner & Prestia

[57] ABSTRACT

The present invention is directed to a mail slot mounting assembly which can be easily installed onto the cross-bars of an existing door without the need for welding or extensive cutting operations to the door frame. The mounting assembly has upper and lower face plates each having an inner surface to be mated and a first pair of wall members running longitudinally along and substantially perpendicular to each of said inner surfaces. The inner surfaces of the upper and lower face plates are configured so that, upon mating the face plates, the first pair of wall members align to form outer channel regions extending longitudinally along and perpendicular to the face plates, the outer channel members being adapted to receive mounting members located in a door. The mated face plates are then configured to receive a mail slot apparatus. Another mail slot mounting assembly is also provided which has a face plate with an inner surface and two substantially parallel outer edge surfaces located perpendicular to the inner surface. Each outer edge surface comprises a C-shaped channel flange capable of slideably receiving cross-bar mounting members located in a door. Another mail slot assembly is also provided which has a wall member running substantially parallel with the perimeter pf each face plate such that upon mating, outer channel regions are formed which are capable of receiving and supporting a mail slot apparatus. In another mail slot assembly, a lower face plate is capable of being receivably mated with an upper face plate.

11 Claims, 6 Drawing Sheets

MAIL SLOT MOUNTING ASSEMBLY

FIELD OF THE INVENTION

The invention relates to mounting apparatus for use in security and storm doors. In particular, this invention relates to a mail slot mounting assembly which can be mounted to cross-members of a door either during or after assembly of the door without welding.

BACKGROUND OF THE INVENTION

Security and storm doors have been manufactured by welding heavy-gauge steel parts to produce a frame such as those shown in FIGS. 6*b* and 6*c*. Typically these frames have cross-bars 12 and 13 to provide structural support as well as aesthetic design. In the past, however, the doors had to be customized to receive a mail slot. The process of customizing (i.e., installing) a mail slot involved removing the door, if it was already mounted, and cutting an opening in the cross-bars to accommodate steel panel pieces for supporting the mail slot to be installed. Both the cross-bars and the panel pieces had to be carefully machined to the proper size, fitted, and carefully held together so that the panel pieces could be welded to the cross-bar pieces.

Typically metal inert gas (MIG) welding was utilized to install the panel pieces. After welding, additional machining was required to smooth weld beads which appeared on visible surfaces in order to provide an aesthetically appealing surface which could then be painted or otherwise finished. FIGS. 6*a*, 6*b* and 6*c* show the cross-bar and panel pieces after installation according to the welding method of the prior art.

This process of installing a mailslot in such welded steel frame doors, however, is labor intensive and thus expensive since it requires the steps of accurately cutting, machining, fitting, welding, and further machining to produce the finished door. Furthermore, if such a door is mounted in a doorway, the process can not be easily performed on-site and thus requires removing the door, bringing it to the manufacturing plant for customization, and then re-mounting the door.

It is an object of this invention to provide a novel mail slot mounting assembly which can be built into a door during the assembly process or easily installed onto the cross-bars of an existing door without the need for welding or extensive cutting operations required in the past. A further object of this invention is to provide a mail slot mounting assembly that can be installed onto the cross-bars of an existing door without dismounting or disassembling the door. It is a still further object of this invention to provide a mail slot mounting assembly which can be readily painted after installation without any special preparation.

SUMMARY OF THE INVENTION

The mail slot mounting assembly of the present invention, which overcomes the above-discussed and numerous other disadvantages and deficiencies of the prior art, comprises upper and lower face plates each having an inner surface to be mated and a first pair of wall members running longitudinally along and substantially perpendicular to each of said inner surface. The inner surfaces of the upper and lower face plates are configured so that upon mating the face plates, the first pair of wall members align to form outer channel regions extending longitudinally along and perpendicular to the face plates. These channel regions mount the completed assembly between the cross-bars of the door. The mated face plates are configured to receive a mail slot apparatus.

In an exemplary embodiment, a second pair of wall members is provided which run longitudinally along and substantially perpendicular to the inner surfaces of each of the face plates, such that the second pair of wall members is located between, and parallel with the first pair of wall members. Upon mating the inner surfaces of said upper and lower face plates, the second pair of wall members align to form an inner wall region capable of receiving and supporting a mail slot apparatus installed through the face plates.

According to another embodiment of the invention, a mail slot mounting assembly comprises a face plate having an inner surface and two substantially parallel outer edge surfaces located perpendicular to the inner surface. Each outer edge surface comprises a C-shaped channel or flange capable of receiving cross-bar mounting members located in a door.

In another embodiment, a pair of wall members is provided which run longitudinally along and substantially perpendicular to the inner surface of the face plate, such that the pair of wall members is located between and parallel with the outer edge surfaces. These wall members are capable of receiving and supporting a mail slot apparatus installed through the face plate.

In another embodiment, a wall member is provided which runs substantially parallel with the perimeter of each face plate such that upon mating, outer channel regions are formed which are capable of receiving and supporting a mail slot apparatus.

In another embodiment, a lower face plate is capable of being receivably mated with an upper face plate.

The present invention also provides that the mail slot assemblies are etch-primed in order to facilitate the adhesion of paint to be applied to the surface.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

Figure 1:
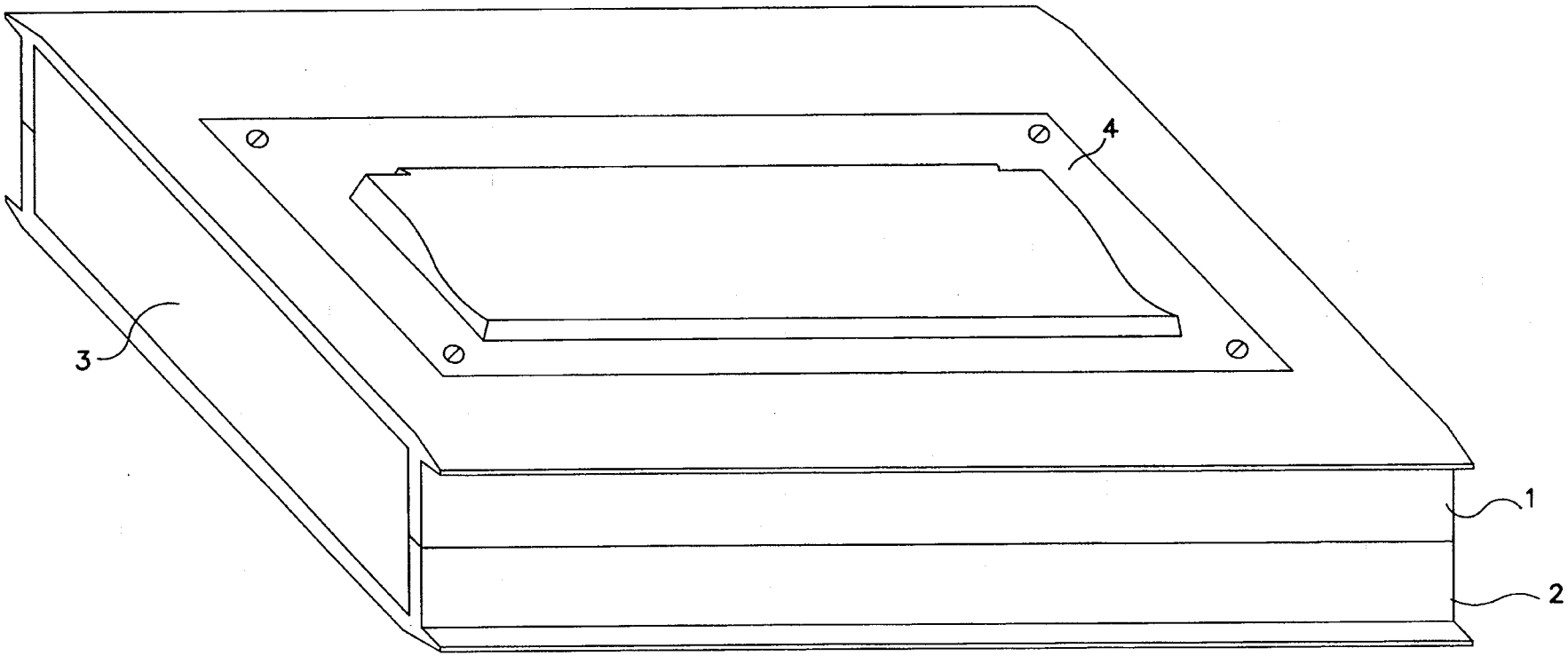
FIG. 1 is a perspective view of a first embodiment of the invention, showing an assembled mail slot assembly.

FIG. 1 shows a mail slot mounting assembly of the present invention with a mounted mail slot. As shown in the figure, the mail slot mounting assembly comprises an upper face plate 1; a lower face plate 2; and cross-sectional end piece 3. A mail slot apparatus 4 is shown mounted on the upper face plate 1. In the exemplary embodiment, the face plates 1 and 2 may be extruded aluminum pieces. It is understood that any other method and/or materials can be employed to produce the face plates as will be realized by those having ordinary skill in the art. The face plates 1 and 2 may be etch-primed in order to facilitate the adhesion of paint to be applied to the surface.

Figure 2:
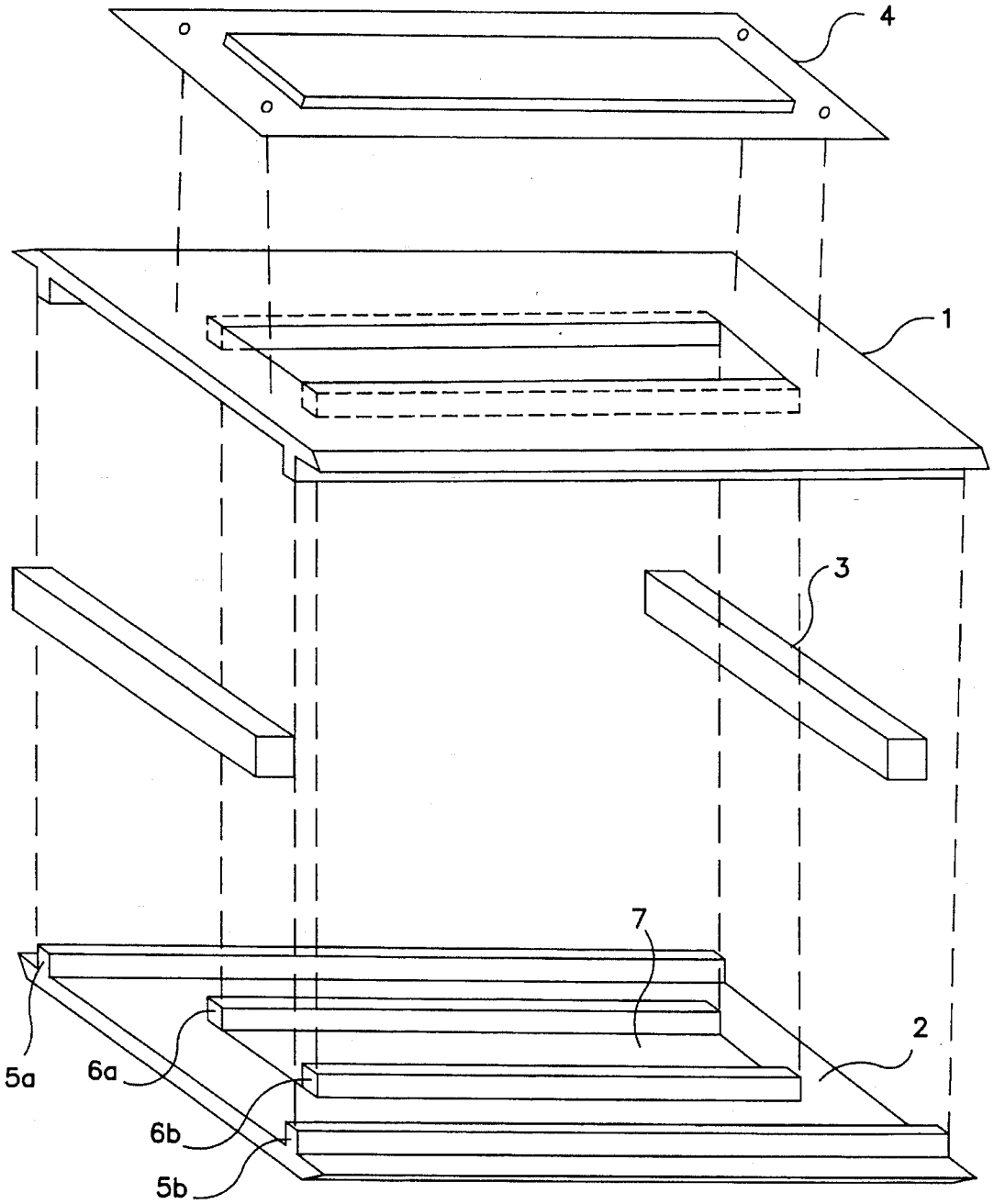
FIG. 2 is a disassembled view of the embodiment of the invention in FIG. 1.

FIG. 2 shows the mail slot mounting assembly of FIG. 1 disassembled to reveal the internal structure of the pieces used prior to assembly. The upper face plate 1 and the lower face plate 2 have inner surfaces upon which are located a first pair of wall members 5*a* and 5*b* running longitudinally along and substantially perpendicular to the face plates. This first pair of wall members is inset a fixed and equal distance from the edge of each face plate so that upon mating the inner surfaces of the face plates, the wall members of each face plate meet. This configuration creates a channel along the length of two edges of the assembled face plates which receives the cross-members of a door.

FIG. 2 also shows cross-sectional end pieces 3 which can be inserted in the each transverse opening formed by the face plates to be mated. Typically these end pieces are square stock pieces and can be used to connect the upper face plate 1 and the lower face plate 2 by providing an adhesive or other fastening means (e.g., screws, bolts, etc.) to hold the inner surfaces of the face plates to the contacted surfaces of the end piece.

Also shown in FIG. 2 is an opening 7 in each face plate located so that, upon mating the upper face plate 1 and the lower face plate 2, an aperture is formed which is capable of receiving a mail slot apparatus 4. The opening 7 is typically formed in the face plates by die-punching, however, any other method can be employed as will be realized by those having ordinary skill in the art.

In an exemplary embodiment of the invention each of the face plates also has a second pair of wall members 6*a* and 6*b* running longitudinally along and substantially perpendicular to the inner surface of each plate. These wall members are formed on each face plate during the extrusion process or can be formed by any other method as will be realized by those having ordinary skill in the art. The wall members are then machined flush with the inner surface of the face plate in the regions which extend longitudinally beyond the opening 7 in each face plate. These machined areas permit a hollow recess to be formed in each transverse end of the assembly capable of receiving cross-sectional end pieces 3. This second pair of wall members is set a fixed and equal distance from the edge of each face plate so that upon mating the inner surfaces of the face plates, the wall members of each face plate meet. This configuration creates inner wall regions between the assembled face plates which are capable of receiving and supporting the mail slot apparatus 4.

The mail slot mounting assemblies of FIGS. 1 and 2 can be assembled before or during the mounting of the assembly into a door. If assembly is done before mounting, the completed assembly may be slid onto the cross-bars of a door. If assembly is done during mounting, an added advantage of the present invention is realized in that the upper and lower face plates can be placed over the existing cross-bars of an existing door without having to disassemble the door frame.

Figure 3:
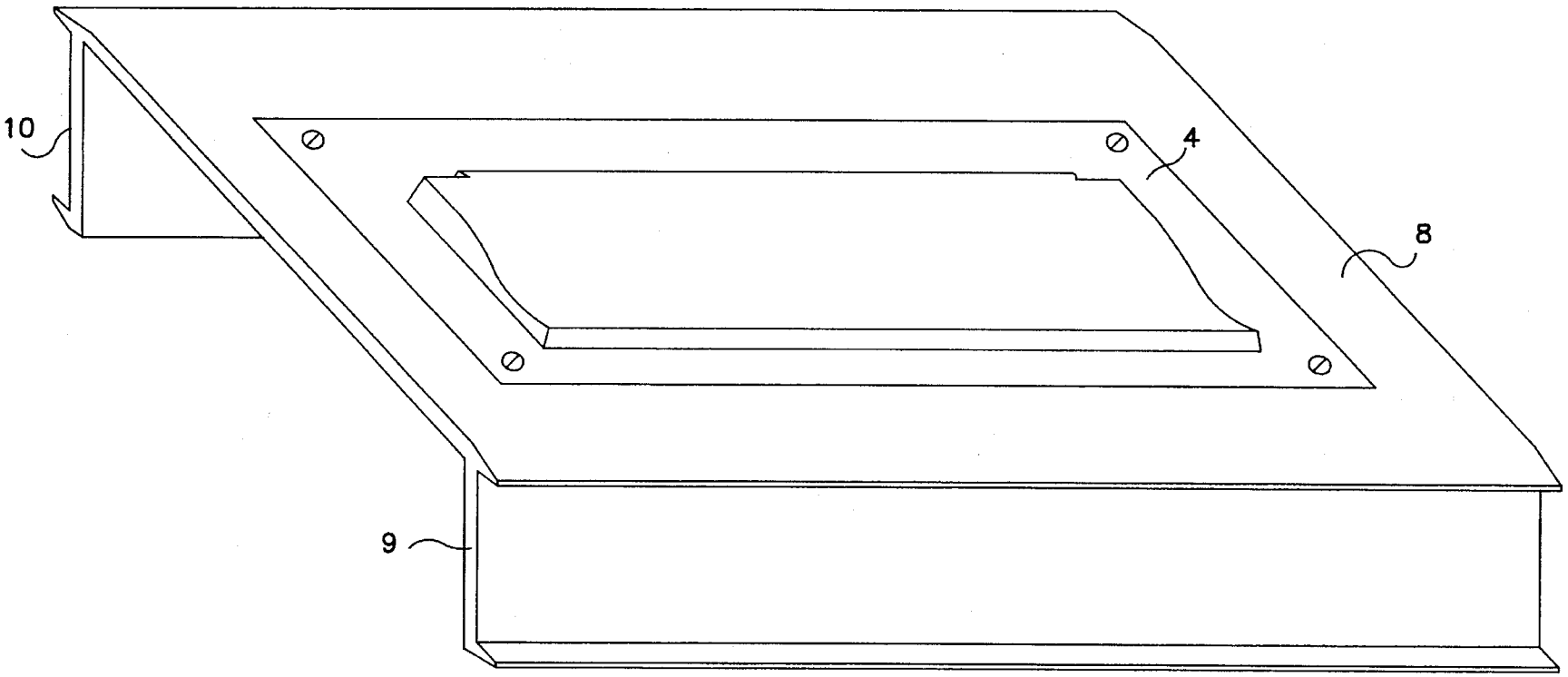
FIG. 3 is perspective view of a second embodiment of the invention, showing an assembled mail slot assembly.

A second embodiment of the present invention is shown in FIG. 3 in which a single face plate 8 is utilized for mounting the mail slot apparatus 4. The face plate 8 has two substantially parallel outer edge surfaces 9 and 10 located perpendicular to the inner surface of the face plate. Each outer edge surface is formed with a C-shaped channel or flange which permits the assembly to be slid onto cross-bar members located in a door. This configuration may also be press fit into the space between the cross-bar members.

The face plate 8 of the second embodiment is typically an extruded aluminum piece, however, any other method and/or materials can be employed as will be realized by those having ordinary skill in the art. The face plate 8 is typically etch-primed in order to facilitate the adhesion of paint to be applied to the surface.

Figure 4:
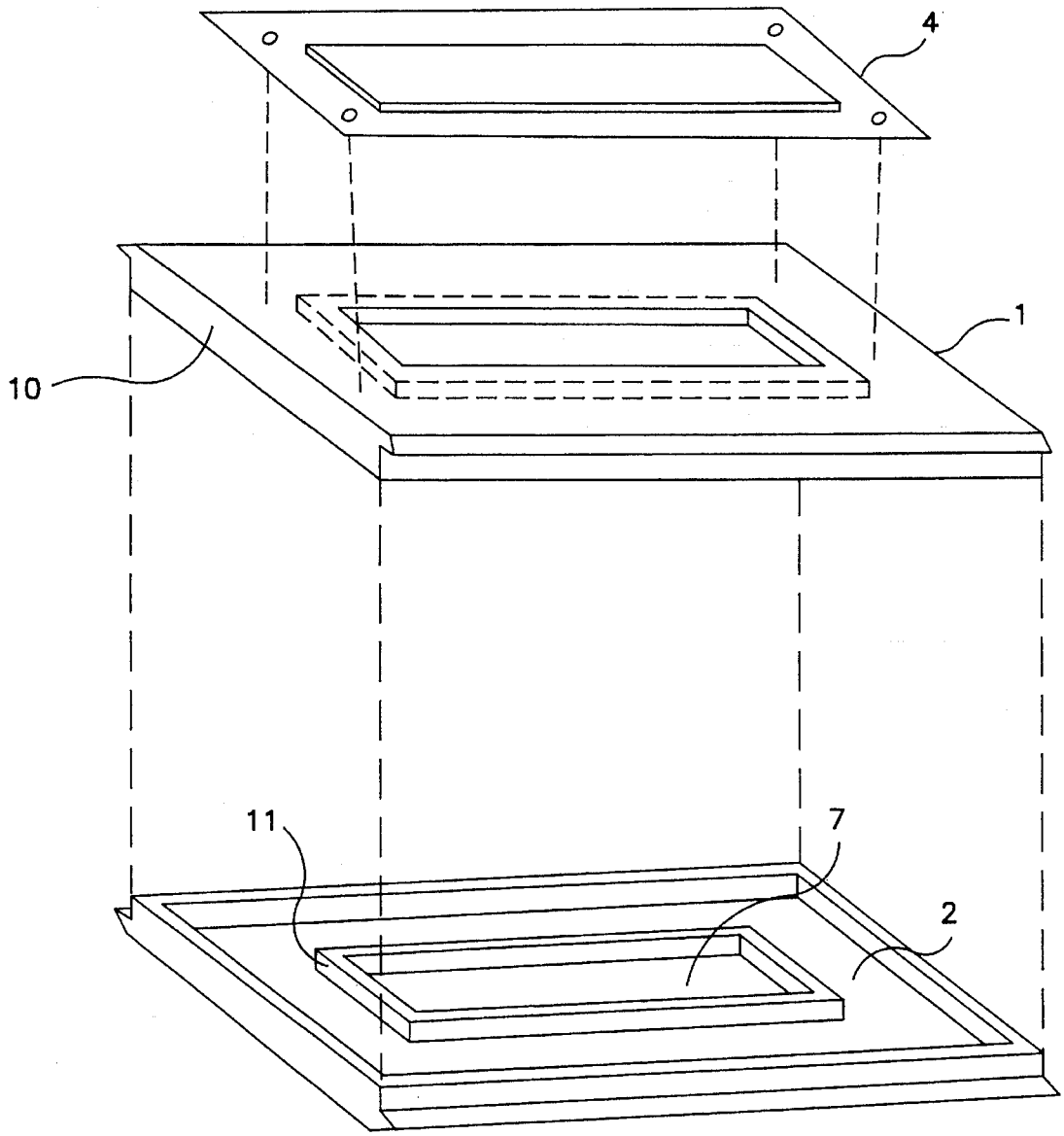
FIG. 4 is a disassembled view of a third embodiment of the invention.

A third embodiment of the present invention is shown in FIG. 4 in which upper and lower face plates 1 and 2 each have inner surfaces to be mated with a first wall member 10 running substantially parallel with the perimeter of each face plate. The first wall member of each face plate is substantially perpendicular to each said inner surface so that upon mating the inner surfaces, the first wall members align to form outer channel regions. These outer channel regions extend longitudinally along the mated face plates and are adapted to receive mounting members located in a door. The mated face plates are also configured to receive a mail slot apparatus installed through at least one of the upper and lower face plates.

This third embodiment can optionally contain second wall members 11 substantially perpendicular to the inner surfaces of each of said face plates as shown in FIG. 4. These second wall members are located interior from the first pair of wall members on the face plates and upon mating the inner surfaces to form an inner wall region capable of receiving and supporting a mail slot apparatus installed through at least one of the upper and lower face plates.

Figure 5:
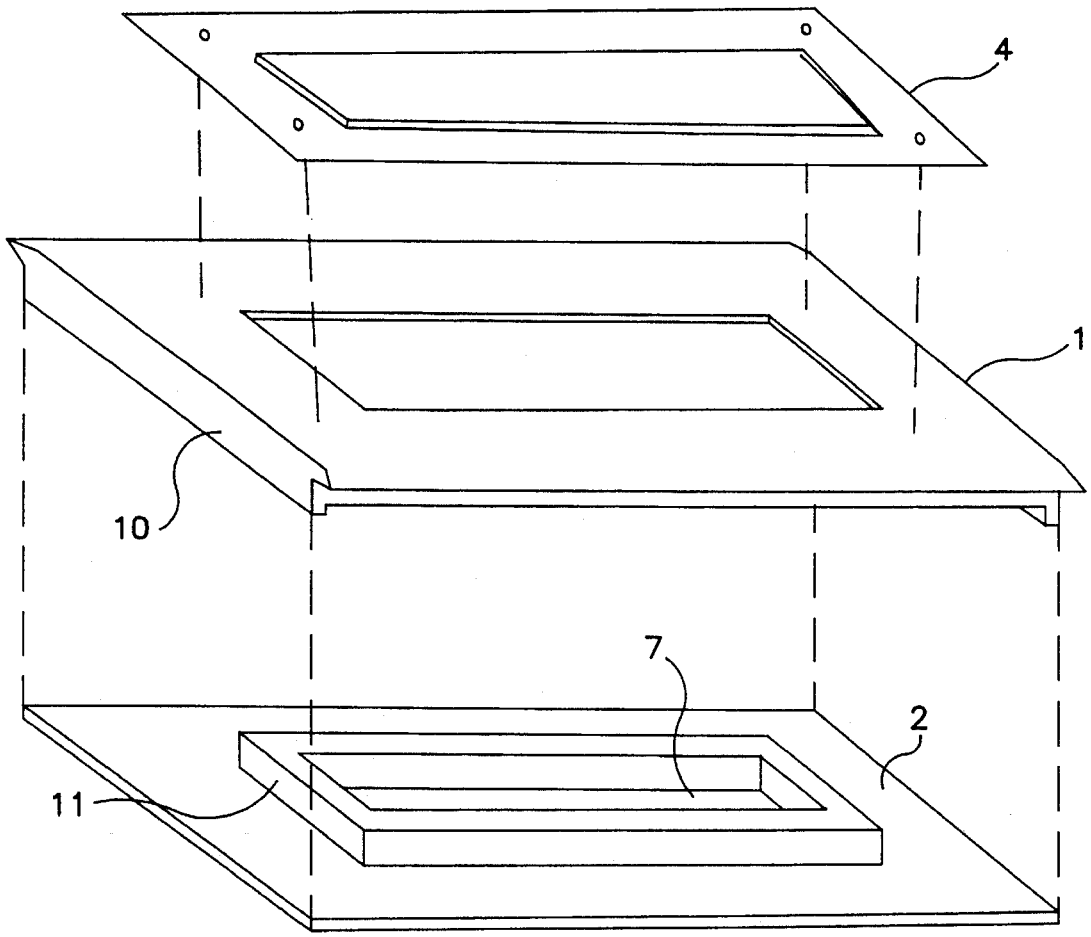
FIG. 5 is a disassembled view of a fourth embodiment of the invention.
Figure 6A:
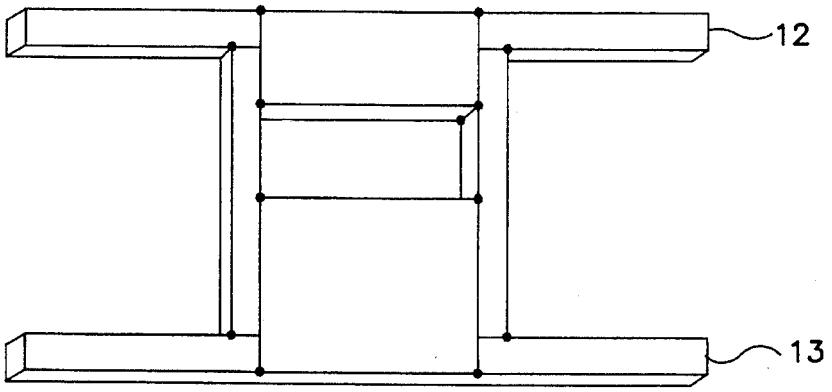
FIG. 6a PRIOR ART
FIG. 6*a* is a perspective view of the prior art cross-brace and welded panel mounting assembly.
Figure 6B:
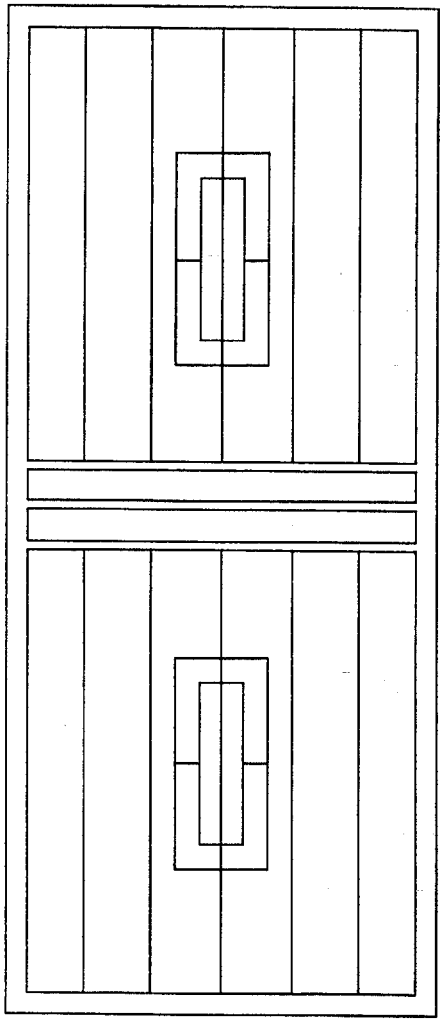
FIG. 6b PRIOR ART
FIGS. 6*b* and 6*c* are perspective views of examples of the doors into which the prior art cross-brace and welded panel mounting assemblies of FIG. 6*a* were welded.
Figure 6C:
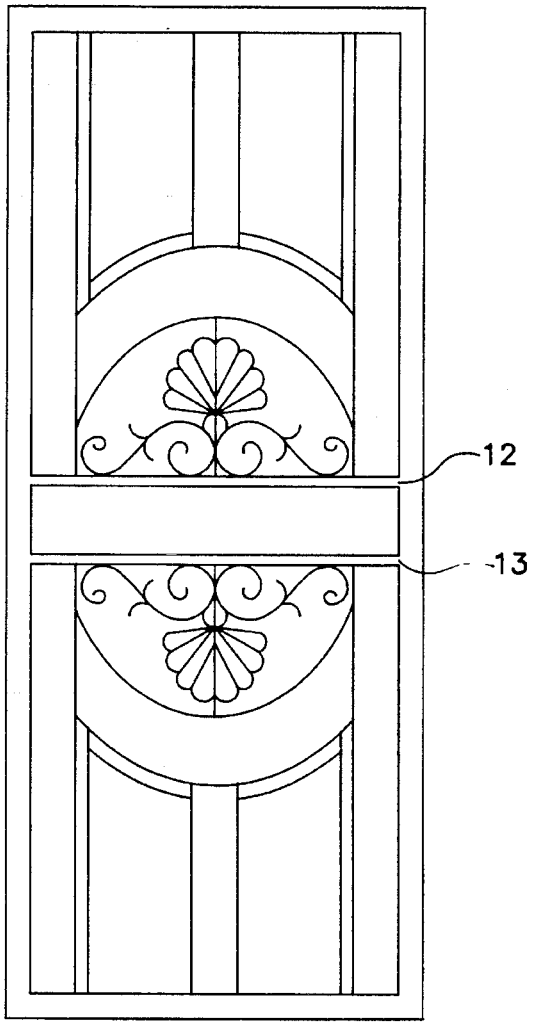
FIG. 6c PRIOR ART

A fourth embodiment of the present invention is shown in FIG. 5 in which an upper face plate 1 has a first wall member 10 running substantially parallel with the perimeter of the upper face plate. This first wall member is also substantially perpendicular to the inner surface of the upper face plate. A lower face plate 2 is also provided which has a second wall member 11 substantially perpendicular to the inner surface of the lower face plate. The lower face plate is capable of being receivably mated with the upper face plate. Upon mating the inner surfaces of the upper and lower face plates, the first pair of wall member forms outer channel regions extending longitudinally along and perpendicular to said face plates. These outer channel regions are adapted to receive mounting members located in a door. The second wall member forms an inner wall region capable of receiving and supporting a mail slot apparatus installed through at least one of the upper and lower face plates.

The face plates of the third and fourth embodiments of the present invention are typically formed by a casting or die-punching operation typically utilizing aluminum metal. Any other manufacturing method, however, can be employed in conjunction with other metals, alloys, and other materials as will be realized by those having ordinary skill in the art.

The mail slot mounting assemblies of FIGS. 4 and 5 can be assembled before or during the mounting of the assembly into a door. If assembly is done before mounting, the completed assembly may be slid onto the cross-bars of a door. If assembly is done during mounting, an added advantage of the present invention is realized in that the upper and lower face plates can be placed over the existing cross-bars of an existing door without having to disassemble the door frame.

According to all of the embodiments, the mail slot assemblies of the present invention can be provided without an opening hole 7 in each plate to permit various size apertures to be custom cut through the face plates at a later time, if so desired. Also, the second wall members *6a* and *6b* or 11 which provide an inner wall region for receiving and supporting a mail slot apparatus are not required and may be eliminated if, for example, the mail slot assembly provides a channel through the door.

It is also understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

The invention claimed is:

1. A mail slot mounting assembly comprising:

upper and lower face plates each having an inner surface to be mated comprising i) a first pair of wall members running longitudinally along and substantially perpendicular to each of said inner surfaces and ii) a second pair of wall members running longitudinally along and substantially perpendicular to said inner surfaces of each of said face plates, wherein said second pair of wall members are located between and parallel with said first pair of wall members, wherein upon mating said inner surfaces of said upper and lower face plates, i) said first pair of wall members align to form outer channel regions extending longitudinally along and perpendicular to said face plates, said outer channel regions being adapted to receive mounting members located in a door, and ii) said second pair of wall members align to form an inner wall region said mated face plates being configured to receive a mail slot apparatus, and said inner wall region capable of receiving and supporting a mail slot apparatus installed through at least one of said upper and lower face plates.

2. A mail slot mounting assembly as recited in claim 1 wherein said assembly has two transverse ends having a hollow recess in each cross-sectional end of said aligned upper and lower face plates and end pieces are inserted in said recesses.

3. A mail slot assembly as recited in claim 2 wherein said end pieces are square stock pieces.

4. A mail slot mounting assembly as recited in claim 1 wherein said face plates contain openings located in the plane of each face plate such that, upon mating the face plates, said openings define an aperture adapted to receive a mail slot apparatus.

5. A mail slot mounting assembly as recited in claim 1 wherein said face plates are manufactured by extrusion.

6. A mail slot mounting assembly as recited in claim 5 wherein said face plates are etch primed.

7. A mail slot mounting assembly comprising:

upper and lower face plates each having an inner surface to be mated and a first pair of wall members running longitudinally along and substantially perpendicular to each of said inner surfaces, wherein upon mating said inner surfaces of said upper and lower face plates, said first pair of wall members align to form outer channel regions extending longitudinally along and perpendicular to said face plates, wherein said outer channel regions are adapted to receive mounting members located in a door, said mated face plates being configured to receive a mail slot apparatus, and wherein said assembly has two transverse ends having a hollow recess in each cross-sectional end of said aligned upper and lower face plates and end pieces are inserted in said recesses.

8. A mail slot assembly as recited in claim 3 wherein said end pieces are square stock pieces.

9. A mail slot mounting assembly comprising:

upper and lower face plates which are extruded and etch primed, each face plate having an inner surface to be mated and a first pair of wall members running longitudinally along and substantially perpendicular to each of said inner surfaces, wherein upon mating said inner surfaces of said upper and lower face plates, said first pair of wall members align to form outer channel regions extending longitudinally along and perpendicular to said face plates, wherein said outer channel regions are adapted to receive mounting members located in a door, said mated face plates being configured to receive a mail slot apparatus.

10. A mail slot mounting assembly comprising:

a face plate having an inner surface and two substantially parallel outer edge surfaces located perpendicular to said inner surface a pair of wall members running longitudinally along and substantially perpendicular to said inner surface of said face plate, wherein each outer edge surface comprises a C-shaped channel flange capable of receiving mounting members located in a door, and said pair of wall members are located between, and parallel with said outer edge surfaces and are capable of receiving and supporting a mail slot apparatus installed through at least one of said upper and lower face plates.

11. A mail slot mounting assembly comprising:

Upper and lower face plates each having an inner surface to be mated comprising i) first wall members running substantially parallel with the perimeter of each of said face plates and substantially perpendicular to each said inner surface, and ii) a second pair of wall members substantially perpendicular to said inner surfaces of each of said face plates, wherein said second wall members are located interior from said first wall members on said face plates wherein upon mating said inner surfaces of said upper and lower face plates, i) said first wall members align to form outer channel regions extending longitudinally along and perpendicular to said face plates, said outer channel regions being adapted to receive mounting members located in a door and ii) said second wall members align to form an inner wall region, said mated face plates being configured to receive a mail slot apparatus installed through at least one of said upper and lower face plates, and said inner wall region capable of receiving and supporting a mail slot apparatus installed through at least one of said upper and lower face plates.

* * * * *